United States Patent [19]

Robertson

[11] Patent Number: 4,638,522

[45] Date of Patent: Jan. 27, 1987

[54] CURLING BROOMS

[76] Inventor: Charles M. Robertson, 36 Simonston Blvd., Thornhill, Ontario, Canada, L3T 4L2

[21] Appl. No.: 710,387

[22] Filed: Mar. 11, 1985

[51] Int. Cl.[4] ..... A46B 17/00; A25B 1/04

[52] U.S. Cl. ..... 15/160; 15/144 B; 15/246

[58] Field of Search ..... 15/144 B, 160, 246, 15/257, 169, 168; 24/16 R, 16 PB; 279/1 K; 211/66; 248/113; 403/104, 109, 377

[56] References Cited

U.S. PATENT DOCUMENTS 4,186,933 2/1980 Derbyshire ..... 279/1 K
4,329,755 5/1982 Alissandratos ..... 15/144 B

FOREIGN PATENT DOCUMENTS 227559 4/1960 Australia ..... 248/113
2478 2/1878 Fed. Rep. of Germany .... 15/144 B

*Primary Examiner*—Peter Feldman
*Attorney, Agent, or Firm*—Fetherstonhaugh & Co.

[57] ABSTRACT

A clothing protection sleeve for a curling broom comprises a tubular sleeve and an elastic connector for connecting the sleeve to the handle of a curling broom. The tubular sleeve is proportioned to slidably receive the free end of a curling broom handle in a free-fitting sliding relationship. The elastic connecting device serves to connect the sleeve to the broom handle while permitting the broom to be used for sweeping purposes during curling while preventing undesirable removal of the sleeve from the broom handle.

2 Claims, 2 Drawing Figures

CURLING BROOMS

FIELD OF THE INVENTION

This invention relates to push-brooms for use in the sport of curling. In particular this invention relates to the provision of a clothing protection sleeve which permits unrestricted use of a curling push-broom while preventing damage to the clothing of the curler due to frictional contact with the broom handle during sweeping.

PRIOR ART

Push brooms or brushes are used to sweep the ice in advance of a curling stone or rock as it travels along the surface of the ice. A conventional curling push broom has a handle which has a length of 48" and a head which is 8" wide. The sweeping action is one in which the head of the push broom is caused to sweep back and forth across the path of travel of the rock. The recommended and most efficient method of using the push broom requires the sweeper to assume a forwardly prone position by bending at the knee of the leading leg. The broom handle is then positioned so that the proximal end thereof bears against the lap formed by the leading leg. The sweeper grips the handle adjacent the head and, while pushing downwardly during the sweeping action, causes the proximal end of the handle to reciprocate to and fro against the clothing covering the lap on which the handle rests. The sweeping action is a vigorous action with the result that considerable friction is generated between the broom handle and the clothing. This friction can cause considerable wear to the clothing and this is a problem which has been long recognized in curling circles. A somewhat similar problem has been experienced by curlers when delivering a rock in that many curlers bring their knee into contact with the ice when completing the delivery. This again results in clothing damage. This problem is generally overcome by wearing a kneepad to prevent clothing wear resulting from contact with the ice. Thus, it will be seen that the conventional practice is to prevent clothing wear by wearing additional protective equipment. It would, however, be difficult and somewhat uncomfortable to wear a protective padding on the lap which is used for supporting the broom handle during sweeping and no such protection has been provided to date.

SUMMARY OF THE INVENTION

It is an object of the present invention to provide a simple and inexpensive clothing protector for curling push brooms.

In order to protect the clothing, I provide a protective sleeve which fits over the proximal end of the broom handle and which can be held stationary against the body of the wearer while permitting movement of the broom handle with respect to the body of the wearer. In use, the broom handle slides within the protective sleeve and no movement occurs between the protective sleeve and the clothing of the sweeper.

To retain the sleeve on the proximal end of the broom handle where it is required, I prefer to close one end of the sleeve. The closing of the proximal end of the sleeve also prevents the sleeve sliding along the handle toward the gripping portion of the handle where it would interfere with the gripping of the handle.

In order to prevent the sleeve falling off of the broom handle when the broom is turned upside down, I prefer to provide an elastic retainer which grips the handle and the sleeve and serves to allow movement of the sleeve with respect to the handle to an extent sufficient to permit effective sweeping while preventing accidental removal of the sleeve.

To minimize the possibility of movement of the sleeve with respect to the clothing of the curler, I prefer to construct the sleeve so that the internal surface has a low coefficient of friction with respect to the broom handle while the external surface has a substantially greater coefficient of friction with respect to conventional clothing worn by curlers.

PREFERRED EMBODIMENT

The invention will be more clearly understood after reference to the following detailed specification read in conjunction with the drawings wherein.

Figure 1:
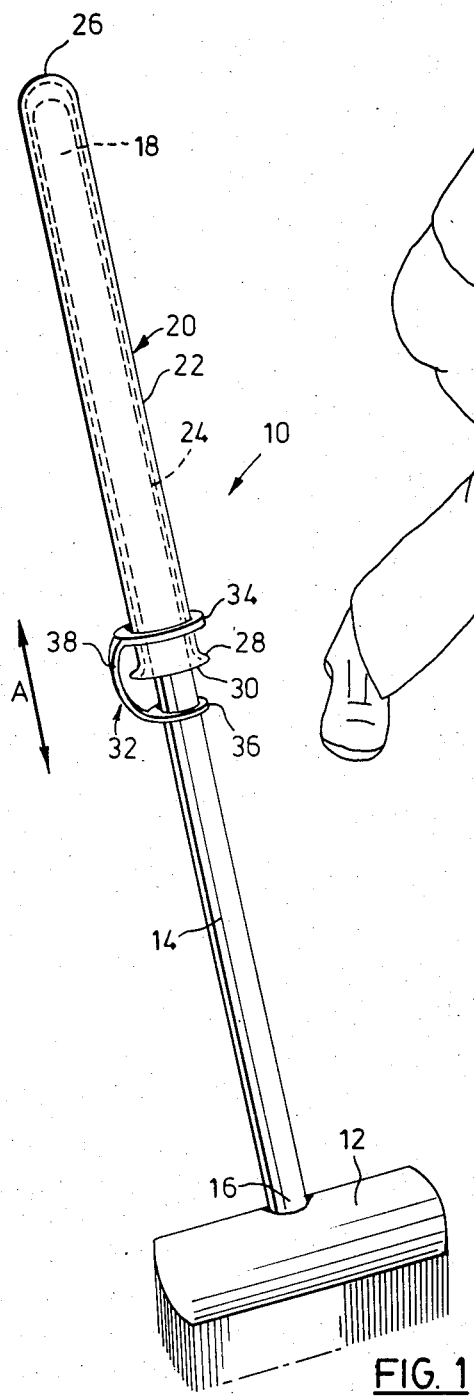
FIG. 1 is a pictorial view of a push broom having a clothing protector sleeve mounted thereon.

With reference to FIG. 1 of the drawings, the reference numeral 10 refers generally to a curling push broom according to an embodiment of the present invention. The push broom 10 comprises a broom head 12 and a handle 14. The distal end 16 of the handle 14 is mounted in the head 12. A clothing protector sleeve generally identified by the reference numeral 20 is positioned on the proximal end 18 of the handle 14. The clothing protector sleeve 20 comprises a tubular body 22 which has a slipway passage 24 opening inwardly from one end thereof and a closed end 26 at the other end thereof. The sleeve 20 also has a shoulder 28 extending about the open end 30 which serves to strengthen the open end of the sleeve.

The clothing protector sleeve 20 is preferably made from a substantially rigid plastics material which has a low coefficient of friction. The slipway passage 24 is formed with a smooth surface and is proportioned to fit in close fitting sliding relationship about the proximal end 18 of the handle so as to be freely movable with respect to the handle in the direction of the arrows A. A retainer 32 is provided which serves to allow the required extent of movement of the sleeve 20 with respect to the handle 14. The elastic retainer 32 comprises a first collar 34, a second collar 36 and a connecting member 38. The first collar 34 is proportioned to fit snugly over the sleeve 20 while being restricted from passing off the sleeve by the shoulder 28. The second collar 36 is proportioned to fit snugly over handle 14 by means of its elasticity. The elastic connecting member 38 has a sufficient length and elasticity to permit free movement of the handle 14 with respect to the sleeve 20 over the full length of stroke required during sweeping while serving to prevent the sleeve falling off of the handle when the broom is turned upside down when not in use.

Preferably the sleeve 22 is proportioned such that the slipway passage 24 may have a total length which is equal to about 60% of the length of the handle 14 of a push broom.

Figure 2:
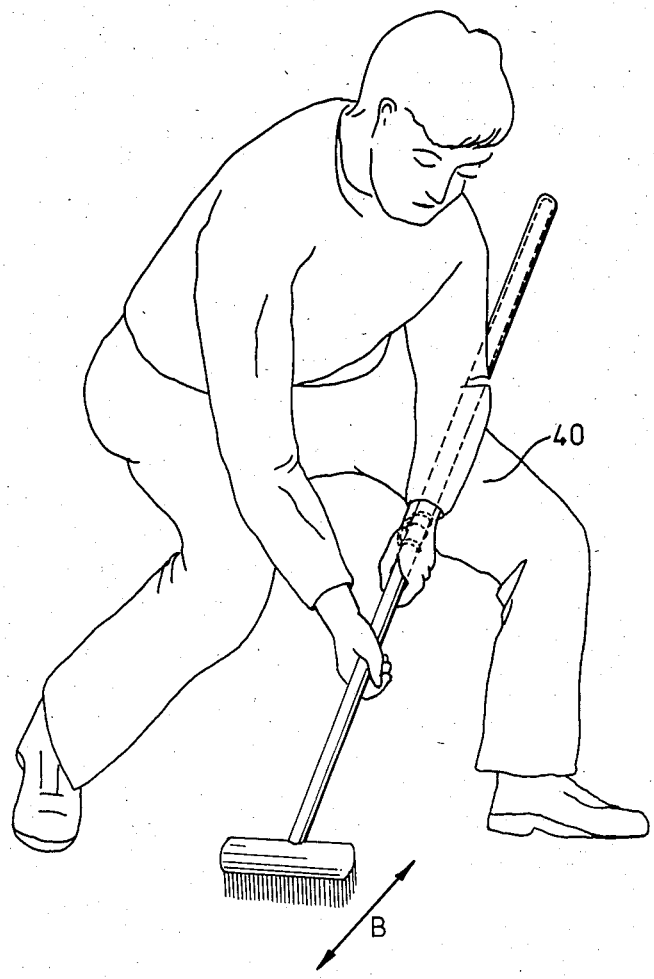
FIG. 2 illustrates the prone position assumed by a curler during sweeping.

In use, when the prone sweeping position shown in FIG. 2 of the drawings the sleeve 20 will extend across the "lap" 40 formed by the leading leg of the curler and will remain substantially stationary during the sweeping action while the handle 18 is free to reciprocate to accomodate sweeping. Thus, it will be seen that the sleeve 20 does not move with respect to the clothing of the curler and as a consequence, little or no clothing wear will occur.

Various modifications of the present invention will be apparent to those skilled in the art without departing from the scope of the invention.

It will be apparent that the advantages to be derived from the use of a sleeve can be obtained without the need to provide the retainer means or to close the proximal end. Nevertheless, substantial practical advantages flow from the use of the retainer in that if the sleeve were to become separated from the handle during the game and come to rest on the ice and thereby come in contact with rock in play or distract other curlers, the progress of the game or other games would be adversely affected.

The embodiments of the invention in which an exclusive property or privilege is claimed are defined as follows:

1. A curling push-broom comprising:

(a) a longitudinally elongated broom handle having a proximal end and a distal end and a longitudinal extent of uniform diameter extending between said ends which is equal to the length of a conventional curling broom handle, (b) a brush head mounted at the distal end of said handle, (c) a sleeve having a slipway opening inwardly from one end thereof, said slipway having a length which is not more than about 60% of the length of said broom handle such that a substantial portion of the handle will project from the sleeve when the broom handle is fully telescoped within the sleeve, said slipway having a substantially uniform diameter along its full length to receive said proximal end of said broom handle in a free-fitting sliding relationship so as to permit reciprocating movement of the handle within said sleeve during sweeping, said proximal end of said broom handle being slidably mounted in said slipway, said sleeve being located on said broom handle so as to be interposed between the broom handle and the point of contact of the broom handle with the clothing of a curler such that during sweeping, the broom handle will move relative to the sleeve while the sleeve remains substantially stationary with respect to the clothing of the curler, thereby to substantially prevent wear damage to the clothing of the curler.

2. A curling broom as claimed in claim 1 further comprising retaining means for retaining said handle on said sleeve in close proximity to its fully retracted position, said retaining means comprises a first elastic collar snugly secured to said sleeve, a second elastic collor snugly secured to said handle and elastic means connecting said first and second collars, said elastic means being extensible to permit sufficient extension to normal.

* * * * *